US006010138A

United States Patent [19]

Bobrowicz et al.

[11] Patent Number: 6,010,138

[45] **Date of Patent: *Jan. 4, 2000**

[54] SHOE FOR GLIDING BOARD

[75] Inventors: Eric Bobrowicz, Monetier Les Bains; Gilles Marmonier, Saint Etienne de Crossey, both of France

[73] Assignee: Skis Rossignol S.A., Voiron, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/919,651

[22] Filed: Aug. 28, 1997

[30] Foreign Application Priority Data

Aug. 30, 1996 [FR] France ..... 96 10803

[51] Int. Cl.[7] ..... A63C 3/02

[52] U.S. Cl. ..... 280/11.36; 280/14.2

[58] Field of Search ..... 280/14.2, 611, 280/613, 11.36; 36/117.6, 117.8, 117.9

[56] References Cited

U.S. PATENT DOCUMENTS 5,079,858 1/1992 Sartor et al. ..... 36/117
5,299,823 4/1994 Glaser .
5,435,080 7/1995 Meiselman .
5,704,139 1/1998 Okajima ..... 36/115
5,727,797 3/1998 Bowles ..... 280/14.2
5,820,155 10/1998 Brisco ..... 280/607

FOREIGN PATENT DOCUMENTS 2604913 4/1988 France .
95/33534 6/1995 WIPO .

*Primary Examiner*—Richard M. Camby
*Assistant Examiner*—Michael Cuff
*Attorney, Agent, or Firm*—Wall Marjama Bilinski & Burr

[57] ABSTRACT

Apparatus for use with a gliding board that includes a shoe having an upper and a sole. A binding for mounting the shoe upon the board having an upwardly raised rear piece and attaching pieces securable to similar pieces on the binding. The upper further includes a frame having a stirrup that encircles the upper and securing mechanism for closing the frame about the shoe.

10 Claims, 3 Drawing Sheets

SHOE FOR GLIDING BOARD

TECHNICAL FIELD

The invention relates to the field of shoes for a gliding board, in particular for the practice of snowboarding, skiing and also, by extension, of ice or roller skating.

It relates more particularly to a shoe structure which is designed for a type of binding specific to snowboarding.

In the rest of the description, the invention will be described more particularly in its application to shoes for snowboarding.

PRIOR ART

As is known, there are several techniques for the practice of snowboarding. Mention may, in particular, be made of a first form termed "alpine gliding" which is practiced on traditional downhill ski pistes, on prepared snow. A second form termed "freestyle" is also known, which takes place on particular runs forming semicylindrical valleys, generally artificially hollowed, and commonly referred to by the expression "halfpipe". Finally, it is also known that snowboarding is practiced on powdery snow slopes.

It is quite clear that each of these modes of use requires a number of properties in the articulation between the user's leg and the board, in particular as regards forward flexing and rearward support.

Chronologically, three different types of shoes have been proposed, to be combined with corresponding bindings which are also different.

Firstly, the first shoes used for the practice of snowboarding were downhill ski boots, that is to say boots having a rigid shell allowing limited forward inclination of the leg. These shoes are fitted to bindings having two elements, namely a fixed stirrup piece into which the heel of the shoe is inserted, and an articulated front stop in the form of a stirrup, capable of engaging the front portion of the toe of the shoe. Quite clearly, this type of shoe proves to be too rigid, in particular in disciplines requiring large angulations of the tibia relative to the foot, such as the technique practiced in halfpipes. This type of shoe also proves to be poorly suited for walking because it is too rigid.

Subsequently, the use of flexible shoes was proposed, these most generally having the form of a boot which is advantageously practical for walking. Unfortunately, the existence of this flexibility made it necessary to develop the bindings in order to allow them to cater for rearward support. Bindings were thus developed having a platform on which the shoe is fixed by several straps and which have a rigid back plate fixed substantially perpendicularly to the board and rising toward the calf. Unfortunately, the use of straps requires adjustment operations every time the shoes are engaged on the board, and it is well known that this takes place frequently in snowboarding, especially when a user reaches a flat region or when he needs to use a ski lift.

Patent WO 95/33534, in particular, has proposed to make the back plate pivot relative to the platform, to permit automatic fitting and removal of the shoe. Unfortunately, this solution does not obviate the problem of securing the front of the foot, which is necessary in order to hold the latter properly with a view to giving good feel.

Another type of binding is also known which employs retractable components, secured to the board, which interact with complementary attachment elements secured to the sole of the shoe. In this case, the shoes have a flexible base and include a number of reinforcements in the regions needed for taking up rearward forces and transferring feel from the board to the foot. More precisely, in document FR 2,733,671, the Applicant has described a shoe which has a frame combining a rigid sole and a back spoiler which is also rigid. Unfortunately, although satisfactory, this solution is substantially equivalent to a rigid shoe and entails discomfort when walking, as well as a deadening of the feel.

Lastly, another type of binding is known which associates automatic attachment means, located substantially at the center of the foot, with a back plate that is secured to the board and can take up rearward forces.

The problem which the invention proposes to solve is to make the holding components continuous from the gliding board to the foot, so as to keep the foot as perfectly as possible in contact with the board, and thus to obtain optimal feel.

A further object of the invention is to prevent the top of the flexible shoe from deforming when the snowboarder executes a pulling movement upward relative to the gliding board.

Another object of the invention is to ensure that the foot presses optimally and constantly on the sole of the shoe, and by extension on the board.

Another problem which the invention proposes to solve is that of compatibility between holding the foot efficiently and firmly, and having a flexible shoe which is beneficial for walking.

DESCRIPTION OF THE INVENTION

The invention therefore relates to a shoe for a gliding board, of the type including:

- a flexible upper that encloses the foot and the lower part of the leg and is associated with a sole,
- an element for attaching the shoe to the gliding board, which is located level with the recess which the sole has for the arch, and is intended to interact with complementary means forming part of the binding to the board, to provide automatic shoe engagement;

said shoe being intended to interact with a binding which includes a rigid rear part that rises at the Achilles tendon and is intended to take up rearward forces.

This shoe is one which includes a frame consisting:

- of a rigid stirrup piece passing under the recess for the arch of the foot, where it is secured to the attachment element, the branches of which stirrup piece rise on either side of the foot before meeting again to the rear of the leg, level with the calcaneus;
- of securing means which join the branches of the stirrup piece and pass over the instep.

The invention therefore consists in equipping an essentially flexible shoe with a structure which, on the one hand, holds the attachment element efficiently to the binding and, on the other hand, holds the foot well against this structure in order to ensure good transfer of feel from the board to the foot.

The foot is thus held in place optimally—to the rear, the stirrup piece blocks the calcaneus by enclosing it from above, and to the front the securing means block the instep. The securing forces on the calcaneus and the instep converge and are directed at the element for attachment to the binding.

Using a stirrup piece restricted to the calcaneus region in no way impairs the rearward inclination of the leg, which makes it easier to walk.

In various embodiments, the rigid stirrup piece may be arranged either outside of the upper, or inside of it, between the upper and the comfort inner shoe.

In the latter case, in order to allow access to the securing means, openings are provided inside the upper in order to pass the securing means out.

In practice, the securing means may consist, for example, of a set of flexible laces, or of a set of straps that are fixed by one end to the branches of the stirrup piece and have locking means on their other end.

According to various alternative embodiments, the adjustment means consist either of a rigid buckle and an articulated hook, or of teeth on one of the straps and a complementary articulated hook.

In order to hold the foot more efficiently relative to the attachment element, the branches of the stirrup piece may advantageously have extensions that are directed forward and are intended to accommodate the securing means. The number and location of these securing means may in this way be optimized.

In a practical embodiment, the rigid stirrup piece has the general shape of a closed loop which, seen from above, assumes a U-shape, and seen from the side has a curved shape passing by the malleoli.

BRIEF DESCRIPTION OF THE DRAWINGS

The way in which the invention is embodied in its application to snowboarding, as well as the advantages which result therefrom will emerge clearly from the following description, supported by the appended figures, in which.

EMBODIMENT OF THE INVENTION

Figure 1:
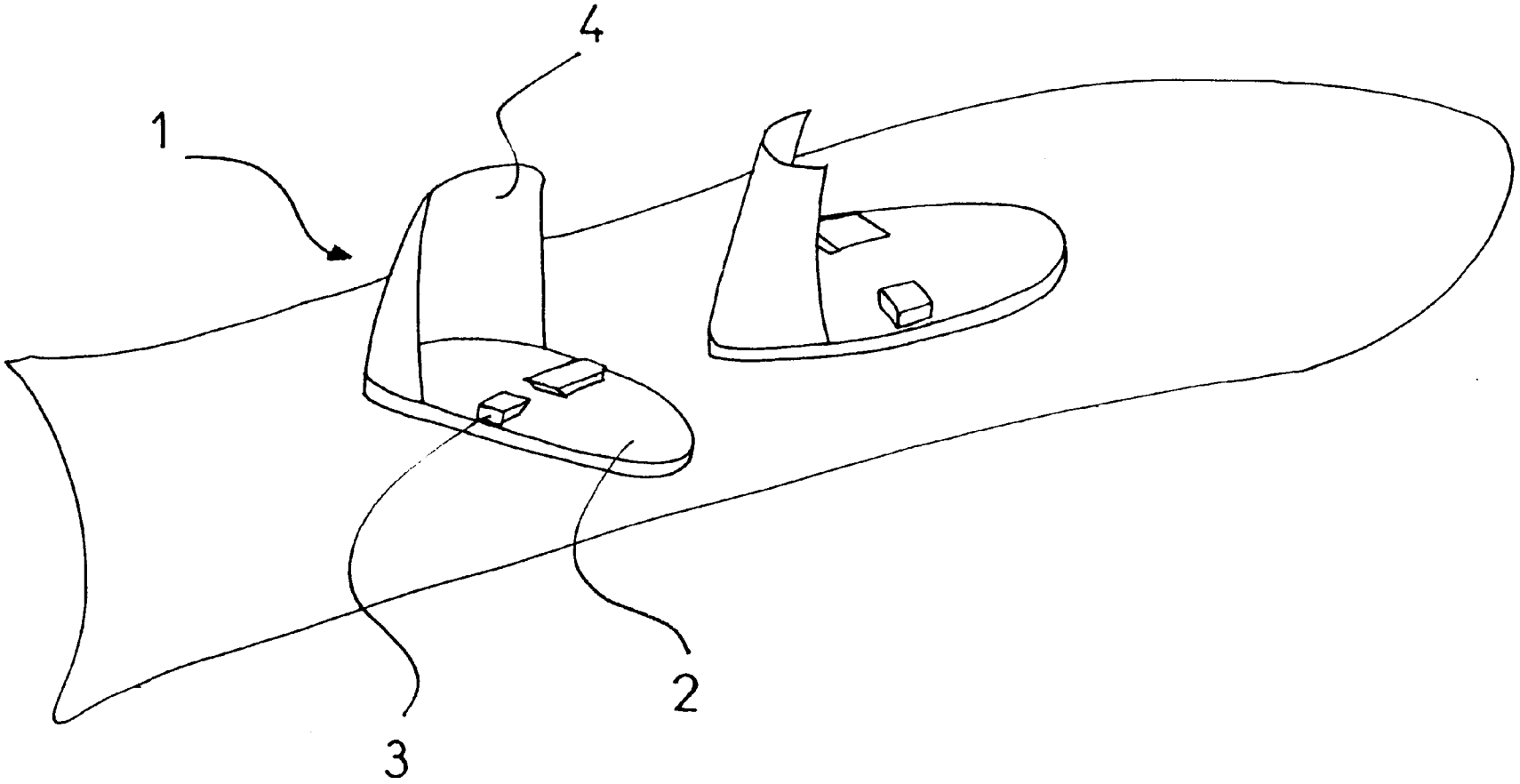
FIG. 1 is an outline perspective view of a snowboard portion equipped with bindings to which the shoes according to the invention fit.

As already mentioned, the invention relates to a shoe for the practice of snowboarding which is intended to fit to a specific type of binding, as illustrated in FIG. 1.

Thus, a binding (1) of this type comprises a plate (2) on which means (3) for attaching a complementary element located under the shoe are mounted.

The invention can be adapted to a very large number of mechanical embodiments, in which this attachment element may, in particular, be produced in the form of a frustoconical block, one or more protruding horizontal pins passing through longitudinal grooves which are provided for this purpose in the sole, or alternatively hollow housings which open to the sides.

This type of binding characteristically has a spoiler (4) arranged facing the back of the foot. It is a rigid spoiler intended to take up the rearward forces exerted by the snowboarder.

Figure 2:
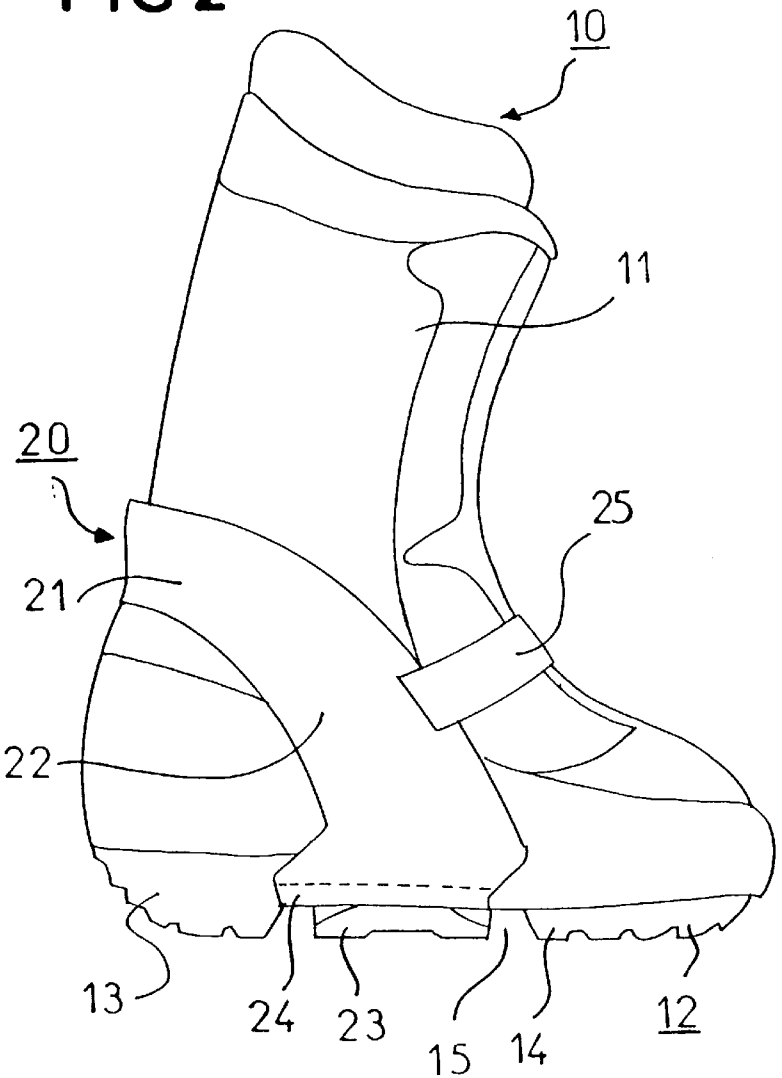
FIG. 2 is a side view of a first alternative embodiment of the invention, in which the stirrup piece is arranged outside of the upper.

The shoe (10) according to the invention, as illustrated in FIG. 2, includes an upper (11) which is substantially in the shape of a boot. This upper (11) is made of a flexible material in order to make it very comfortable for the user, especially when walking. This upper (11) is associated at the bottom with a sole (12) consisting mainly of a front part (14) and a rear part (13) located level with the heel. Between these two parts (13) and (14), the sole has a recess (15) corresponding to the arch of the foot.

In the first embodiment, illustrated in FIG. 2, this upper (11) is associated with a characteristic frame (20). This frame (20) is essentially composed of the element (23) for attachment to the binding, the stirrup piece (21) passing behind the leg, substantially level with the calcaneus, and a securing strap (25) joining the branches (22) while passing over the instep. In practice, this frame may be fitted on or obtained by overmolding.

As regards the attachment element (23), as already mentioned, it can have a wide variety of forms and the invention is in no way restricted to the embodiment of a frustoconical block as illustrated in FIG. 2.

The stirrup piece (21) has a substantially plane part (24) arranged in the recess (15) which the sole (12) has for the arch of the foot, the attachment element (23) being secured to the stirrup piece. Clearly, this securing may be obtained in various ways, for example screwing, adhesive bonding, overmolding, or alternatively by molding a monobloc piece.

As a variant, it may be advantageous to join this stirrup piece (21) to the inner sole of the shoe.

Two branches (22), leading up and to the rear, and advantageously passing the malleoli, start from the lateral ends of the plane portion (24). These two branches (22) join up at the rear, substantially level with the calcaneus. The rear junction region of these two branches (22) is arranged in such a way as to provide optimal holding, and may therefore extend slightly upward in the direction of the Achilles tendon, and downward in the direction of the heel proper, but without rising too high so as to cause no hindrance when walking. It is essentially necessary for this stirrup piece to leave an open region to allow passage of the rear part (13) of the sole (12) , the purpose of this being to allow feel to be transferred from the snowboard through a relatively flexible region of the upper.

In the embodiment illustrated in FIG. 2, the securing means arranged at the front consist of a strap (25) equipped with blocking means (not shown). In order to hold the attachment element (3) as securely as possible, this strap (25) should be pressed firmly onto the upper (11) in order to prevent any movement of the foot inside the upper (11) , in particular if the leg flexes forward or backward, and thereby to ensure continuous action between the board and the foot.

Figure 3:
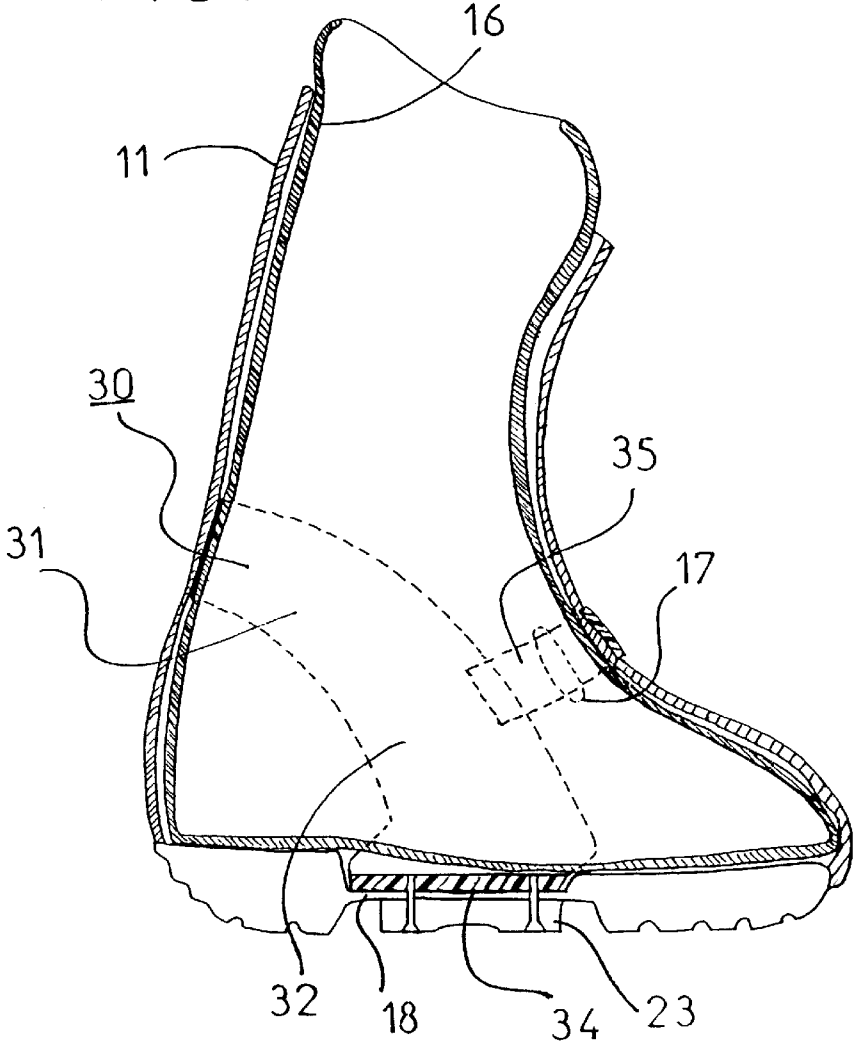
FIG. 3 is a section of a second alternative embodiment of the invention, in which the frame is arranged between the upper and the comfort inner shoe.

In a second embodiment, illustrated in FIG. 3, the frame may be essentially arranged inside of the upper (11), between the upper itself and the reinforcing inner shoe (16) . In this case, the stirrup piece (30) assumes a substantially similar shape to the stirrup piece (20) described above, and essentially includes a plane part (34) which is arranged level with the recess for the arch of the foot, level with a less thick region (18) of the sole (12) . In this case, the attachment element (23) is secured to the plane part (34) , through this thin portion (18) of the sole (12) by any practical means, in particular screwing or riveting.

In order to ensure that the securing means (35) are accessible, the upper has openings (17) (illustrated by dashes) allowing the strap (35) to pass out.

As regards the securing means, they may be produced, as already mentioned, by laces or by straps.

Figure 4:
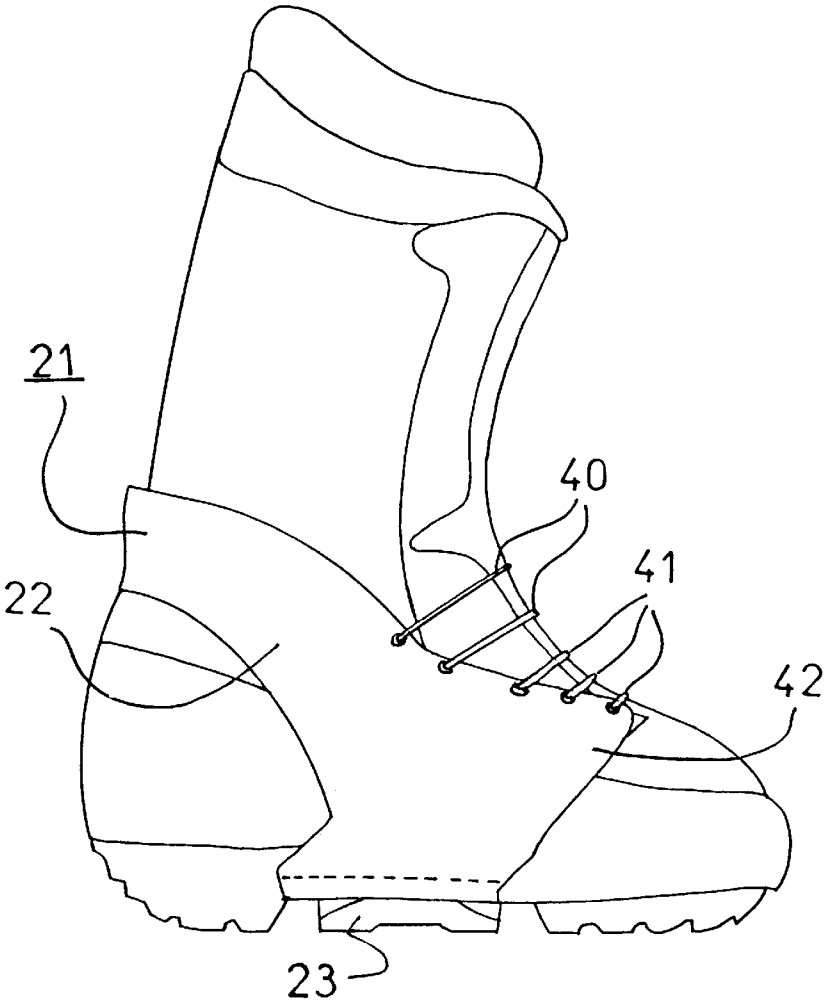
FIG. 4 is a side view of a third alternative embodiment, in which the stirrup piece has extensions for anchoring the securing means.

As illustrated in FIG. 4, the front part of the stirrup piece (21) , or more precisely of each of the branches (22), has extensions (42) allowing additional securing means to be anchored.

Thus, as represented, they consist of a set of laces (40) passing by the instep, and supplemented by additional laces (41) passing over the middle of the tarsi. This ensures that the foot is held efficiently relative to the attachment element (23) , which proves to be a particular advantage, especially during forward flexing.

Figure 5:
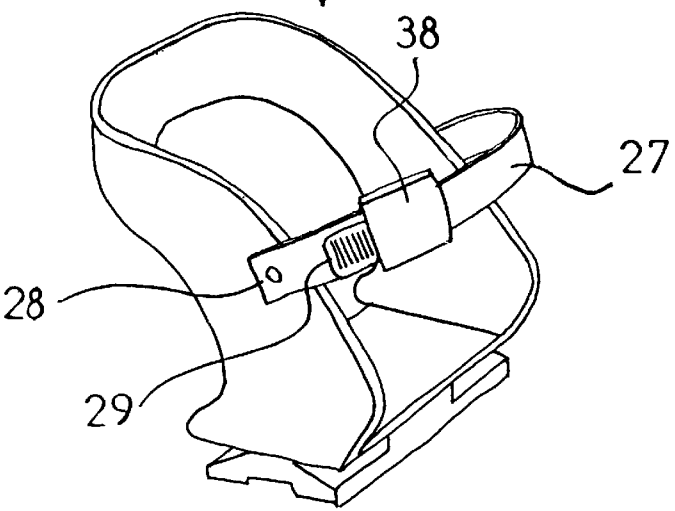
FIG. 5 is an outline perspective view of a frame according to the invention, equipped with a securing strap.

In an alternative embodiment, illustrated in FIG. 5, the frame (20) is shown on its own and has two straps (27, 28). The end (29) of the strap (27) is toothed and penetrates a hook (38) mounted at the free end of the strap (28). This hook (38) is articulated and has catches for blocking the toothed end (29) of the strap (27).

The above description shows that the shoe according to the invention has the following multiple advantages, namely:

the use of a flexible upper which is particularly comfortable for walking and which has front and rear sole parts that allow good transfer of feel at the heel and the toes;

firm and efficient holding of the foot relative to the binding attachment element, which prevents any floating of the foot inside the upper, which would reduce the control over the response of the board.

As already mentioned, the invention is particularly useful in its application to snowboards. Nevertheless, it can be used on other gliding boards.

We claim:

1. Apparatus for use with a gliding board that includes a shoe having a flexible upper that encloses the foot and lower part of a wearer's leg to encompass the Achilles tendon region and a sole having flexible front and rear portions mounted upon the bottom of the upper, said sole having an arch region in the mid-section of the sole, a binding mounted upon a gliding board for receiving said shoe that includes a rigid rear piece that extends upwardly along the Achilles tendon region of the shoe, a rigid attachment element mounted on the mid section of the shoe sole said attachment element extending in its entirety in the arch portion of the shoe for interacting with complementary means on said binding to secure the shoe to the binding, said shoe further including a frame having a rigid stirrup piece that passes under the arch section of the sole and engages the attaching piece, said stirrup piece having a pair of branches that rise upwardly to either side of the shoe that are cojoined at the back of the shoe above a wearer's calcaneus region, and securing means for joining the branches of the stirrup that pass over the instep of the shoe.

2. The apparatus of claim 1 wherein the stirrup piece is mounted outside the flexible upper.

3. The apparatus of claim 1 wherein the stirrup piece is mounted inside said upper between the upper and an inner shoe.

4. The apparatus of claim 3 wherein the upper contains openings for permitting the securing means to pass out of said upper.

5. The shoe of claim 1 wherein said securing means includes a set of flexible laces.

6. The apparatus of claim 1 wherein the securing means consists of straps that are fixed at one end to the branches and having interlocking means at the other end for releasably joining said straps.

7. The apparatus of claim 6 wherein the locking means includes a rigid buckle and an articulated hook.

8. The apparatus of claim 6 wherein the locking means includes a plurality of teeth mounted on one of the straps and an articulated hook for coacting with the teeth.

9. The apparatus of claim 1 wherein the branches of the stirrup piece include extensions that are directed forwardly and which are adapted to receive thereon the securing means.

10. The apparatus of claim 1 wherein the rigid stirrup piece is in the shape of a U-shaped loop and said branches are arcuate shaped to pass adjacent to the wearer's malleoli.

* * * * *